US011066772B2

(12) United States Patent
Bockos et al.

(10) Patent No.: US 11,066,772 B2
(45) Date of Patent: Jul. 20, 2021

(54) LAUNDRY WASHING MACHINE PROVIDED WITH A CONTROL PANEL

(71) Applicant: Electrolux Appliances Aktiebolag, Stockholm (SE)

(72) Inventors: Giancarlo Bockos, Verona (IT); Vittorio Cascianelli, Charlotte, NC (US)

(73) Assignee: Electrolux Appliances Aktiebolag, Stockholm (SE)

( * ) Notice: Subject to any disclaimer, the term of this patent is extended or adjusted under 35 U.S.C. 154(b) by 171 days.

(21) Appl. No.: 16/063,851

(22) PCT Filed: Dec. 22, 2016

(86) PCT No.: PCT/EP2016/082326
§ 371 (c)(1),
(2) Date: Jun. 19, 2018

(87) PCT Pub. No.: WO2017/114737
PCT Pub. Date: Jul. 6, 2017

(65) Prior Publication Data

US 2018/0371672 A1 Dec. 27, 2018

(30) Foreign Application Priority Data

Dec. 29, 2015 (EP) ..... 15202861

(51) Int. Cl.
*D06F 34/28* (2020.01)
*D06F 39/02* (2006.01)
(Continued)

(52) U.S. Cl.
CPC ..... *D06F 34/28* (2020.02); *D06F 39/02* (2013.01); *D06F 37/02* (2013.01); *D06F 39/088* (2013.01)

(58) Field of Classification Search
CPC ..... D06F 39/02; D06F 39/028; D06F 34/28
See application file for complete search history.

(56) References Cited

U.S. PATENT DOCUMENTS 5,262,132 A 11/1993 Bricker et al.
6,434,977 B1 * 8/2002 Hapke ..... D06F 39/02 68/17 R
(Continued)

FOREIGN PATENT DOCUMENTS

DE 3238540 A1 4/1984
DE 3302893 A1 8/1984
(Continued)

OTHER PUBLICATIONS

WO2013068886A1 Description (with paragraph numbering) (Year: 2013).*
(Continued)

*Primary Examiner* — Spencer E Bell
(74) *Attorney, Agent, or Firm* — RatnerPrestia

(57) ABSTRACT

A laundry washing machine equipped with a treating agents dispenser comprising compartments adapted to be filled with at least one treating agent and a control panel comprising input devices allowing the user to select or set washing programs and/or parameters of the machine and comprising output devices for giving information to the user of features of said machine and/or a feedback to the user related to the settings/status of the machine. At least one output device of said the devices and at least one compartment of the compartments comprise a common visual identifier.

11 Claims, 6 Drawing Sheets

(51) Int. Cl.
*D06F 37/02* (2006.01)
*D06F 39/08* (2006.01)

(56) References Cited

U.S. PATENT DOCUMENTS

| | | | | |
|---|---|---|---|---|
| 2006/0272360 | A1* | 12/2006 | Hsu | A47L 15/4454 68/19 |
| 2007/0241938 | A1 | 10/2007 | Ulius-Sabel et al. | |
| 2008/0276382 | A1 | 11/2008 | Benne et al. | |
| 2009/0095028 | A1 | 4/2009 | Hoppe et al. | |
| 2010/0000022 | A1 | 1/2010 | Hendrickson et al. | |
| 2010/0000023 | A1* | 1/2010 | McAllister | D06F 34/28 8/137 |
| 2010/0000025 | A1 | 1/2010 | Dalton et al. | |
| 2010/0000578 | A1* | 1/2010 | Hendrickson | D06F 39/022 134/34 |
| 2010/0000581 | A1 | 1/2010 | Doyle et al. | |
| 2011/0173536 | A1* | 7/2011 | Payne | D06F 43/002 715/716 |
| 2013/0098450 | A1* | 4/2013 | Frantz | D06F 95/00 137/1 |
| 2013/0290902 | A1 | 10/2013 | Martin et al. | |
| 2017/0022651 | A1 | 1/2017 | Bilancio et al. | |

FOREIGN PATENT DOCUMENTS

| | | | | |
|---|---|---|---|---|
| DE | 102009011678 | A1 | 8/2010 | |
| DE | 102011078471 | A1 | 1/2013 | |
| EP | 1847643 | A2 | 10/2007 | |
| WO | 2004109005 | A1 | 12/2004 | |
| WO | 2013068886 | A1 | 5/2013 | |
| WO | WO-2016146321 | A1 * | 9/2016 | D06F 35/006 |

OTHER PUBLICATIONS

WO2016146321A1 Machine Translation (Year: 2016).*
International Search Report and Written Opinion for International Application No. PCT/EP2016/082326, dated Feb. 2, 2017—10 pages.
International Search Report and Written Opinion for International Application No. PCT/EP2016/082335, dated Feb. 10, 2017, 13 pages.
Non Final Office Action for U.S. Appl. No. 16/063,861, dated Apr. 29, 2020, 18 pages.
Final Office Action for U.S. Appl. No. 16/063,861, dated Jun. 30, 2020, 10 pages.
Notice of Allowance for U.S. Appl. No. 16/063,861, dated Oct. 5, 2020, 12 pages.

* cited by examiner

LAUNDRY WASHING MACHINE PROVIDED WITH A CONTROL PANEL

This application is a U.S. National Phase application of PCI International Application No. PCT/EP2016/082326, filed Dec. 22, 2016, which claims the benefit of European Application Na. 15202861.9, filed Dec. 29, 2015, both of which are incorporated by reference herein.

The present invention concerns the field of laundry washing techniques.

In particular, the present invention refers to a laundry washing machine equipped with an improved control panel.

BACKGROUND ART

Nowadays the use of laundry washing machines, both "simple" laundry washing machines (i.e. laundry washing machines which can only wash and rinse laundry) and laundry washing-drying machines (i.e. laundry washing machines which can also dry laundry), is widespread.

In the present description the term "laundry washing machine" will refer to both simple laundry washing machines and laundry washing-drying machines.

Laundry washing machines generally comprise an external casing, or cabinet, provided with a washing tub which contains a rotatable perforated drum where the laundry is placed. A loading/unloading door ensures access to the drum.

Laundry washing machines typically comprise a water supply unit and a products supply unit, or dispenser, for the introduction of water and treating agents (i.e. detergent, softener, rinse conditioner, etc.) into the tub. The treating agents dispenser is advantageously connected to a water source (water mains).

Known treating agents dispensers comprise one or more compartments adapted to be filled with at least one treating agent.

The treating agents dispenser is generally located inside the cabinet, immediately above the washing tub, and is structured for selectively feeding into the washing tub, according to the washing program manually-selected by the user via a control panel generally located on the front wall of the cabinet, a given amount of detergent, softener and/or other washing agent suitably mixed with fresh water arriving from the water mains; and with a fresh-water supply circuit structured for selectively drawing fresh water from the water mains according to the washing program manually-selected by the user, and channeling said water into the treating agents dispenser or directly into the washing tub.

The treating agents dispenser, in turn, generally comprises a detergent drawer which is usually divided into a number of detergent compartments each structured for being manually fillable with a corresponding treating agent, and which is fitted/inserted in manually extractable manner into a completely recessed drawer housing whose entrance is located on front wall of the cabinet, above the door, and whose bottom wall preferably directly communicates with the inside of the washing tub via a connecting duct.

Known laundry washing machines are usually provided with a user interface comprising a dashboard or control panel with input devices such as touch sensitive input devices knobs, buttons, etc., allowing the user to select or set washing and/or drying programs or allowing the user to select or set washing and/or drying options for the specific selected program. The control panels are typically provided also with output devices such as LEDs, displays, alphanumeric displays, warning lights, icons, texts etc. for giving information to the user of the features of the machine and/or a feedback to the user related to the settings/status of the machine.

Laundry washing machines of known type are characterized by a great number of washing programs and also by a great number of program options.

For example, it is also possible to chose among various washing programs to suit the needs of every user such as: cotton, wool, silk, delicate, synthetic, jeans, or heavy duty, whitest whites, etc.

Furthermore, it is possible to chose among various program options to suit the needs of every user such as: washing water temperature (hot, worm, cold, . . . ), soil level (heavy, normal, light, . . . ), spin speed (high, medium, low, . . . ), stain treat, extra rinse, time settings, etc.

It is also known that each washing program and its options provides for filling one or more compartments of the dispenser with corresponding treating agents.

For example, "heavy duty" program needs detergent in the main wash compartment, detergent in the pre-wash compartment, and optionally softener and/or bleach in the respective compartment; a washing program including a stain treatment option provides for a stain remover in a respective compartment.

The laundry washing machines of the known art pose some drawbacks.

A drawback posed by known laundry washing machines is the difficulty for the user to prepare the machine with the treating agents according to the washing program and/or options selected, due to the great number of combinations resulting from the program and options available.

This induce the user to continuously consult the user manual or even cause to fill the wrong compartment and/or to use the wrong treating agent.

Furthermore, complexity due to the great number of combinations leads the user to use substantially only the same program for any kind of load, which makes he/she the life easier but does not take advantage of efficiency deriving from the great availability of programs/options of the laundry washing machine.

A further drawback posed by known laundry washing machines lies in that the user may insert a particular treating agent in the respective compartment and then select a program for the particular load inserted in the drum but said particular treating agent may eventually damage the load. This may be caused by the lack of information on the correlation between the options selectable by the user, the particular treating agent associated to selected option and the selected washing program. For example, the user could select the stain treatment option and fill the respective compartment with a stain remover and then select the "delicate" program with delicate clothes inserted in the drum. The stain remover will eventually damage the delicate clothes.

The object of the present invention is therefore to overcome the drawbacks posed by the known techniques.

It is an object of the invention to provide a laundry washing machine with features that improves the usability of laundry washing machine for users.

It is another object of the invention to provide a laundry washing machine with features that allows exploiting the potential and efficiency of the laundry washing machine.

DISCLOSURE OF INVENTION

The applicant has found that by providing a laundry washing machine comprising a treating agents dispenser having compartments for the treating agents and a control panel comprising input devices allowing the user to select or set washing programs and/or parameters and output devices for giving information to the user of features of said machine and/or a feedback to the user related to the settings/status of said machine and by providing one of the output devices and one compartment with a common visual identifier, it is possible to improve the usability of the laundry washing machine compared to known systems.

The present invention relates, therefore, to a laundry washing machine connectable to a water mains comprising:

- a cabinet supporting a washing drum adapted to receive laundry and a washing tub external to said washing drum;
- a treating agents dispenser connectable to said water mains and comprising compartments adapted to be filled with at least one treating agent;
- a supply line, fluidly connecting said treating agents dispenser and said washing tub;
- a control panel comprising input devices allowing the user to select or set washing programs and/or parameters of said machine and comprising output devices for giving information to the user of features of said machine and/or a feedback to the user related to the settings/status of said machine;
- a control unit for controlling functioning of said laundry washing machine; wherein at least one output device of said output devices and at least one compartment of said compartments comprise a common visual identifier.

In a preferred embodiment of the invention, said at least one output device of said output devices comprises a first visual identifier and said at least one compartment of said compartments comprises a second visual identifier and wherein said first identifier and said second identifier have the same colouring.

Preferably, said first visual identifier differs from visual identifiers of other output devices.

Also preferably, said second visual identifier differs from visual identifiers of other compartments.

According to a preferred embodiment of the invention, said colouring comprises a colour.

In a preferred embodiment of the invention, said colouring comprises a combination of colours.

According to a preferred embodiment of the invention, the first visual identifier is associated to a specific washing program or to a specific washing program option which provides for that a specific treating agent is inserted into said at least one compartment.

Preferably, the specific washing program or the specific washing program option provides for that a pre-wash phase is performed and that the specific treating agent which is inserted into said at least one compartment is a detergent.

Also preferably, the specific washing program or the specific washing program option provides for that a stain treatment phase is performed and that the treating agent which is inserted into said at least one compartment is a stain remover.

In a preferred embodiment of the invention, the first visual identifier is both associated to a specific washing program and to a specific washing program option which provides for that a specific treating agent is inserted into said at least one compartment.

In a further preferred embodiment of the invention, the specific washing program provides for that a pre-wash phase is performed and the specific washing program option provides for that a stain treatment phase is performed and the specific treating agent which is inserted into said at least one compartment is a stain remover.

Preferably, said at least one of said output devices comprises one or more of the elements of the group comprising: alphanumeric, texts, lines, images, icons, lights, LEDs displays, alphanumeric displays or a combination thereof.

BRIEF DESCRIPTION OF THE DRAWINGS

Further characteristics and advantages of the present invention will be highlighted in greater detail in the following detailed description of preferred embodiments of the invention, provided with reference to the enclosed drawings. In the drawings, corresponding characteristics and/or components are identified by the same reference numbers. In such drawings.

DETAILED DESCRIPTION OF THE INVENTION

Figure 2:
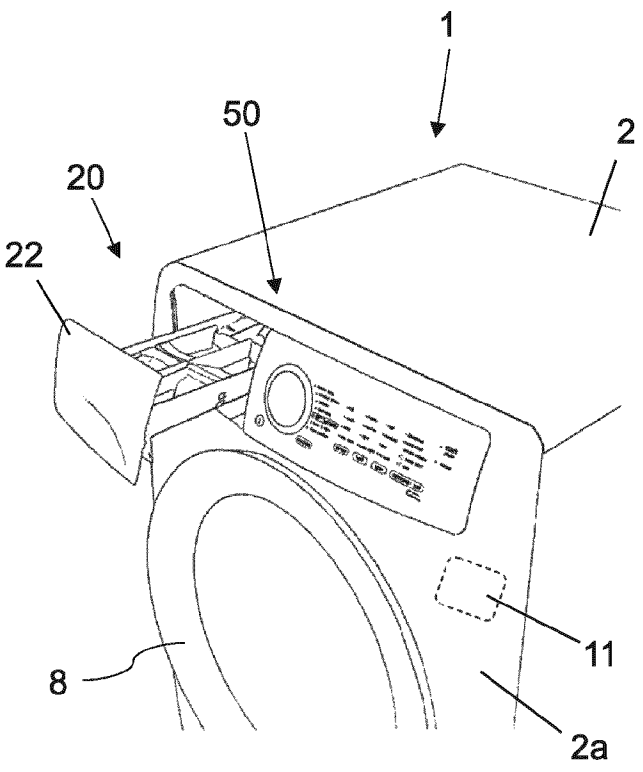
FIG. 2 is a partial view of the laundry washing machine of the FIG. 1 with the drawer in its opened position.

The present invention has proved to be particularly advantageous when applied to laundry washing machines, as described below. It should in any case be underlined that the present invention is not limited to laundry washing machines. On the contrary, the present invention can be conveniently applied to laundry washing-drying machines (i.e. laundry washing machines which can also dry laundry).

In the present description, therefore, the term "laundry washing machine" will refer to both simple laundry washing machines and laundry washing-drying machines.

With reference to Figures from 1 to 3 a laundry washing machine 1 according to a preferred embodiment of the invention is described.

The laundry washing machine 1 comprises an external casing or cabinet 2, in which a washing tub, not visible, is provided that contains a perforated washing drum, not visible, where the laundry to be treated can be loaded.

The tub and the drum both preferably have a substantially cylindrical shape.

The cabinet 2 is provided with a loading/unloading door 8 which allows access to the drum.

The tub is preferably suspended in a floating manner inside the cabinet 2, advantageously by means of a number of coil springs and shock-absorbers, not illustrated.

The drum is advantageously rotated by an electric motor, not illustrated, which preferably transmits the rotating motion to the shaft of the drum, advantageously by means of a belt/pulley system. In a different embodiment of the invention, the motor can be directly associated with the shaft of the drum.

The drum is advantageously provided with holes which allow the liquid flowing therethrough. Said holes are typically and preferably homogeneously distributed on the cylindrical side wall of the drum.

Laundry washing machine 1 advantageously comprises a control unit 11 connected to the various parts of the laundry washing machine 1 in order to ensure its operation.

The laundry washing machine 1 preferably comprises a treating agents dispenser 20 which is housed inside the casing 2 in easily reachable manner by the user, and is structured for selectively feeding into the washing tub, according to the selected washing program, a given amount of detergent, softener and/or other treating agent suitably mixed with the fresh water arriving from the water mains, or even simply a given amount of fresh water arriving from the water mains. A fresh-water supply circuit is structured for being connectable to the water mains and for selectively channeling the fresh water from the water mains to the treating agents dispenser 20 and/or directly to the washing tub preferably while controlling/regulating the flow of fresh water towards the treating agents dispenser 20 and/or the washing tub.

The treating agents dispenser 20 preferably comprises a removable drawer 22 connected to the frontal side wall 2*a* of the cabinet 2, opportunely in an upper region of the latter, positioned above the tub.

Figure 1:
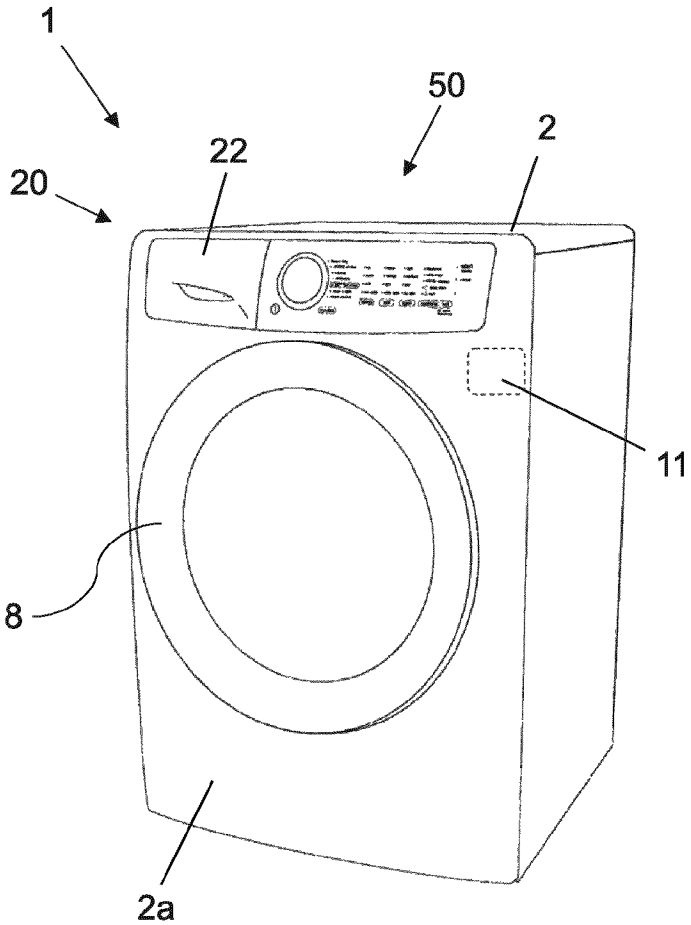
FIG. 1 is a perspective view of a front-loading, home laundry washing machine according to a preferred embodiment of the present invention.
Figure 3:
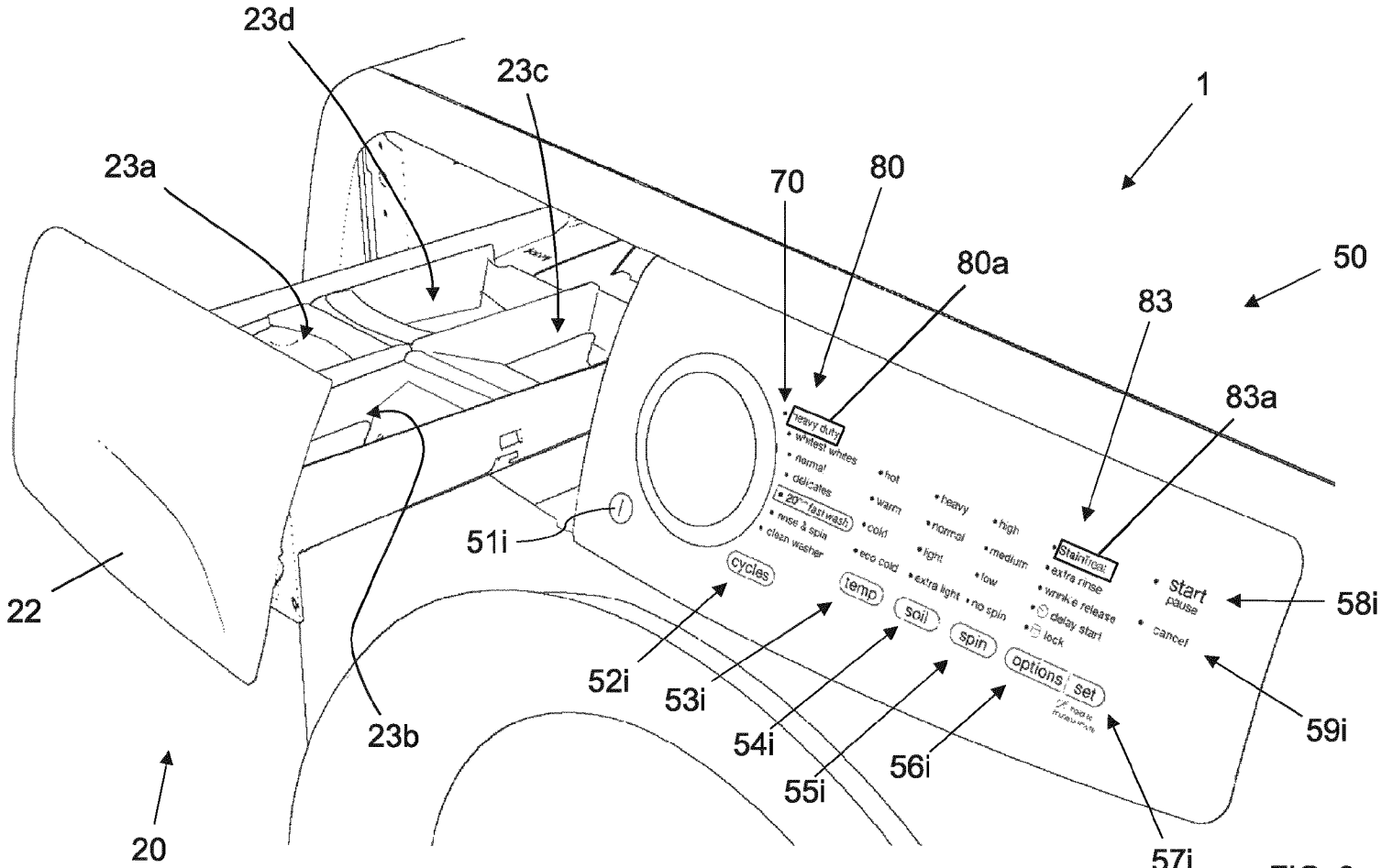
FIG. 3 is an enlarged view of a particular of FIG. 2.

The removable drawer 22 can be extracted from the frontal side wall 2*a* such as to protrude from the cabinet 2 in an opened loading position easily accessible by the user, as illustrated for example in FIGS. 2 and 3, or can be fully inserted in an operative position, as illustrated for example in FIG. 1.

The drawer 22 is preferably provided with one or more compartments 23*a*, 23*b*, 23*c*, 23*d* having bottom and side walls adapted to be filled with treating agents.

In the embodiment illustrated in the Figures, there are four compartments, 23*a*, 23*b*, 23*c* and 23*d*.

In different embodiments, the number of compartments may be different, according to the desired type and/or number of treating agents which are used in the particular model of laundry washing machine.

The first compartment 23*a* is preferably adapted for receiving a powder or a liquid detergent for the main wash. The second compartment 23*b* is preferably adapted for receiving a softener. The third compartment 23*c* is preferably adapted for receiving bleach. The fourth compartment 23*d*, according to an aspect of the present invention, is preferably adapted for receiving another treating agent, as will better explained later.

The first compartment 23*a* is then preferably marked with the text "main wash", the second compartment 23*b* is preferably marked with the softener symbol and the text "liquid softener" and the third compartment 23*c* is preferably marked with the bleach symbol and the text "liquid bleach".

Laundry washing machine 1 preferably comprises an interface unit 50, or control panel, connected to the control unit 11, accessible to the user and by means of which the user may select or set washing programs or he/she may select or set washing options for the specific selected washing program.

In case of a laundry washing-drying machine, the user may also select or set drying programs and/or drying options for the specific selected drying program.

The control panel 50 comprises input devices by means of which the user selects or sets the washing programs and/or selects or sets washing options for a specific washing program.

The input devices of the preferred embodiment illustrated and described herein preferably comprise an on-off push button 51*i*, a washing program selection button 52*i*, a temperature selection button 53*i*, a soil level selection button 54*i*, a spin speed selection button 55*i*, an options selection button 56*i*, a set button 57*i*, a start/pause button 58*i* and a cancel button 59*i*.

The on-off push button 51*i* is used to switch on and off the laundry washing machine 1.

The washing program selection button 52*i* is used to select the desired washing program among seven washing programs, preferably "heavy duty", "whitest whites", "normal", "delicates", "20 min fast wash", "rinse & spin" and "clean washer".

In different embodiments, a rotary knob may be advantageously used instead of the washing program selection button 52*i*.

The temperature selection button 53*i* is used to select the desired washing water temperature for the washing program selected though the washing program selection button 52*i*. The temperature selection button 53*i* allows the selection of the washing water temperature preferably among four levels, preferably "hot", "warm", "cold" and "eco cold".

The soil level selection button 54*i* is used to select the soil level of the laundry, preferably "heavy", "normal", "light" and "extra light".

The spin speed selection button 55*i* is used to select the desired spin speed for the washing program selected though the washing program selection button 52*i*. The spin speed selection button 55*i* allows the selection of the speed preferably among four levels, preferably "high", "medium", "low" and "no spin".

The options selection button 56*i* is used to select the desired option for the washing program selected though the washing program selection button 52*i*. The options selection button 56*i* allows the selection of one or more options, preferably "StainTreat", "extra rinse", "wrinkle release", "delay start" and "lock".

The set button 57*i* is used to set various parameters, for example to set the delay time when the "delay start" option is set.

The start/pause button 58*i*, preferably a touch sensitive button, is used to start the washing cycle or to pause the cycle in progress.

The cancel button 59*i*, preferably a touch sensitive button, is used to cancel previous selection/s.

Further to input devices, the control panel 50 comprises output devices by means of which information to the user of the features of the machine are given and/or a feedback related to the settings/status of the machine is given.

The output devices of the preferred embodiment illustrated and described herein preferably comprise texts and LEDs.

In different embodiments, output devices may comprise different elements such as displays, alphanumeric displays, lines, images, icons, lights etc., or a combination thereof.

Output devices comprise a first type of output devices that let the user know which are the selectable washing programs that can be performed by the laundry washing machine 1.

First type of output devices preferably comprise texts, such as "heavy duty", "whitest whites", "normal", "delicates", "20 min fast wash", "rinse & spin" and "clean washer".

Furthermore, output devices comprise a second type of output devices that let the user know which are the selectable options for the selected washing program that can be performed by the laundry washing machine 1.

Second type of output devices preferably comprise texts, such as "hot", "warm", "cold" and "eco cold" for the washing temperature or "heavy", "normal", "light" and "extra light" for the soil level or the text "StainTreat".

Output devices then comprise further output devices that give a feedback to the user on the settings of the laundry washing machine.

Said further output devices preferably comprise LEDs which are preferably arranged next to said texts, for example a LED 70 is placed at the left of the text "heavy duty".

The LEDs give a feedback to the user on the settings of the laundry washing machine. For example, said LED 70 when ON indicates that the respective "heavy duty" washing program has been selected.

The same applies to the other LEDs of the control panel 50 which are preferably arranged at the left of each of said texts.

As said above, the desired washing program is selected through the washing program selection button 52*i*. Once a washing program has been selected, the user fills with the proper treating agent/s the compartment/s of the dispenser 20.

For example, if the "normal" washing program has been selected the user fills the first compartment 23*a* with a dose of detergent and, optionally, the second compartment 23*b* with a dose of softener and the third compartment 23*c* with a dose of bleach.

Some of the washing programs normally provide for the fourth compartment 23*d* to be filled with a proper treating agent for an efficient washing cycle.

For example, "heavy duty" washing program normally provides for the fourth compartment 23*d* to be filled with an additional dose of detergent which allows to perform a pre-wash phase during the washing cycle.

The pre-wash phase will be performed utilizing the additional dose of detergent of the fourth compartment 23*d* before the main wash phase. The main wash phase will be then performed utilizing the dose of detergent of the first compartment 23*a*.

According to the invention, the first type output device constituted of the text "heavy duty" comprises a first visual identifier 80.

In the preferred embodiment here illustrated, the first visual identifier 80 comprises a border frame 80*a* surrounding the text "heavy duty". The border frame 80*a* preferably comprises a determined colouring, more preferably has a specific colour, for example a green border frame.

According to the invention, the fourth compartment 23*d* is characterized by a second visual identifier 90.

In the preferred embodiment here illustrated, the second visual identifier 90 comprises a tab 90*a*, preferably a plastic tab. The plastic tab 90*a* may be a member connected to the fourth compartment 23*d* or, alternatively, integrally made with it. The tab 90*a* preferably comprises a specific colouring which is the same colouring of the border frame 80*a* of the first visual identifier 80, more preferably has the same specific colour, for example green.

According to the invention, the same colouring of the boarder frame 80*a* of the text "heavy duty" and of the fourth compartment 23*d* gives an indication to the user of a link between the two, i.e. that the "heavy duty" washing program implies the use of the fourth compartment 23*d*.

The user who selects the "heavy duty" washing program will be therefore advised to fill the fourth compartment 23*d* with an additional dose of treating agent, in the present case a dose of detergent for the pre-wash phase.

Advantageously, by providing the first type output device, preferably the text "heavy duty", with a first visual identifier 80 and by providing the fourth compartment 23*d* with a second visual identifier 90 wherein both the first identifier 80 and the second identifier 90 comprise the same colouring, the usability of laundry washing machine for the user is improved. The visual identifiers 80, 90, in fact, immediately show the link between the "heavy duty" washing program and the fourth compartment 23*d*.

Still advantageously, the "heavy duty" washing program will be performed efficiently with the use of detergent in the pre-wash phase.

While the first visual identifier 80 is constituted by a green border frame 80*a* and the second visual identifier 90 is constituted by a green tab 90*a*, it has to be underlined that in different embodiments the first visual identifier associated to the first type output device and the second visual identifier associated to one of the compartment can be differently realized.

By way of example, without this implying any loss of generality, the first visual identifier may comprise a coloured background for the text "heavy duty" or the characters themselves of the text "heavy duty" may be coloured, for example green characters.

By way of example, without this implying any loss of generality, the second visual identifier may be realized by colouring the whole compartment, or part of it, for example by colouring the bottom side or the side walls thereof, or by providing a coloured light which illuminates the compartment or any other coloured visual identifier associated to the compartment.

It is also clear that the common colouring which characterizes the first and second visual identifiers may comprise a plain colour or any nuance of colour, for example green colour as described above, or also a particular combination of colours.

It is clear that these generalizations may be applied to all the embodiments described in the present application.

Figure 4:
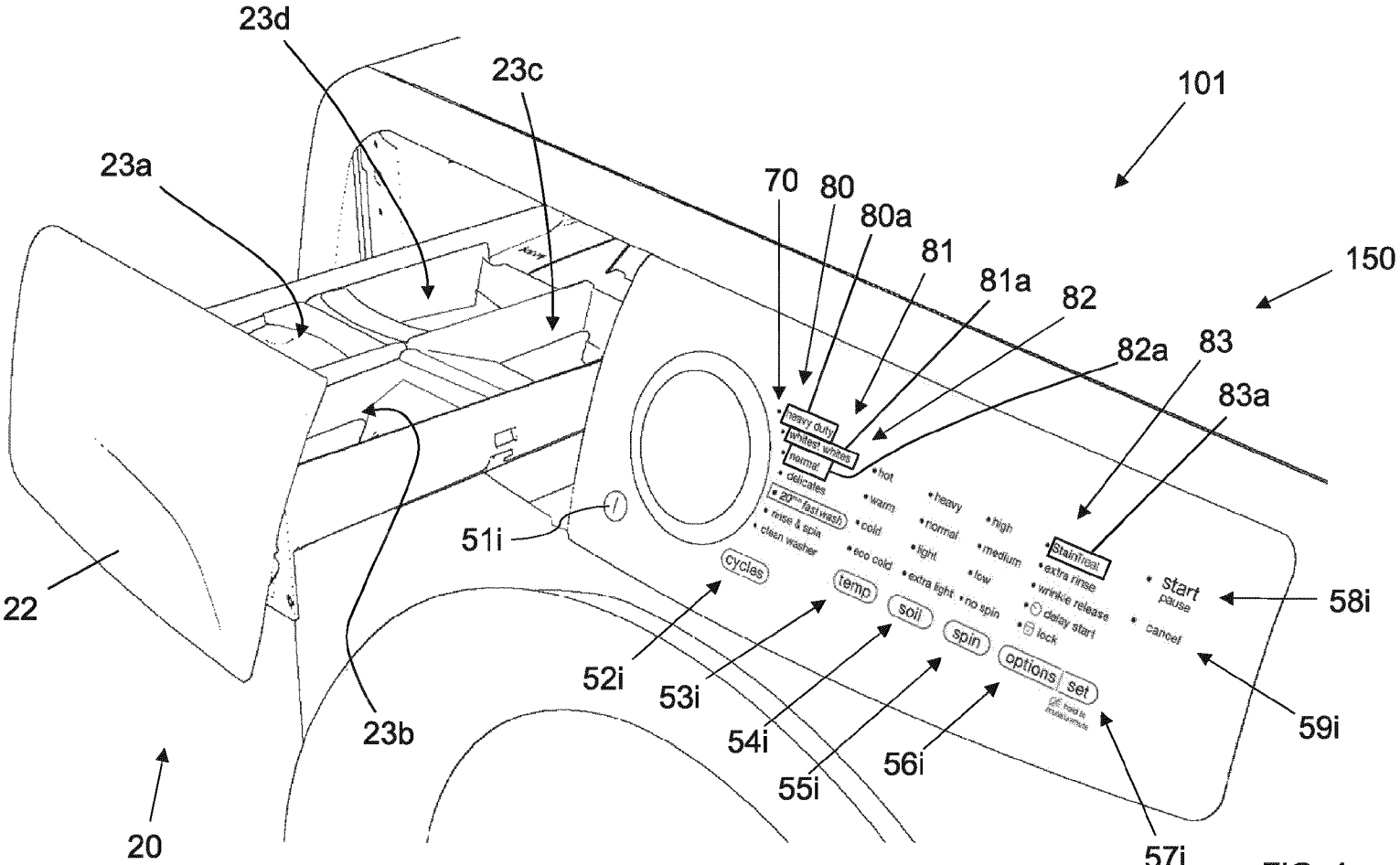
FIG. 4 shows another preferred embodiment of FIG. 3.

With reference to FIG. 4 a laundry washing machine 101 according to a further preferred embodiment of the invention is described.

The laundry washing machine 101 differs from the laundry washing machine 1 previously described in that also the first type output devices of the control panel 150 constituted of the texts "whitest whites" and "normal" are characterized by a respective visual identifier 81 and 82.

In the preferred embodiment here illustrated, each visual identifier 81, 82 comprises a border frame 81*a*, 82*a* surrounding the respective text "whitest whites" and "normal". Each border frame 81*a*, 82*a* preferably comprises a determined colouring, more preferably the same specific colour, for example a green border frame.

The laundry washing machine 101 according to this preferred embodiment provides for the fourth compartment 23*d* to be filled with an additional dose of detergent which allows to perform a pre-wash phase during anyone of the selected washing program among the three washing programs, i.e. "heavy duty", "whitest whites" and "normal".

According to the invention, the same colouring of the border frames 80*a*, 81*a*, 82*a* of the texts "heavy duty", "whitest whites", "normal" and of the fourth compartment 23*d* gives an indication to the user of a link between one of the washing program and the fourth compartment 23*d*, i.e. that each of the three washing programs implies the use of the fourth compartment 23*d*.

The user who selects one of these three washing programs will be therefore advised to fill the fourth compartment 23*d* with an additional dose of treating agent, in the present case a dose of detergent for the pre-wash phase.

Advantageously, by providing the first type output devices, preferably the texts "heavy duty", "whitest whites" and "normal", with a visual identifier 80, 81, 82 and by providing the fourth compartment 23*d* with a visual identifier 90 wherein all the identifiers 80, 81, 82 and 90 comprise the same colouring, the usability of laundry washing machine 1 for the user is improved. The visual identifiers 80, 81, 82, 90, in fact, immediately show the link between one of the "heavy duty", the "whitest whites" and the "normal" washing program and the fourth compartment 23*d*.

Still advantageously, the selected washing program will be performed efficiently with the use of detergent in the pre-wash phase.

Figure 5:
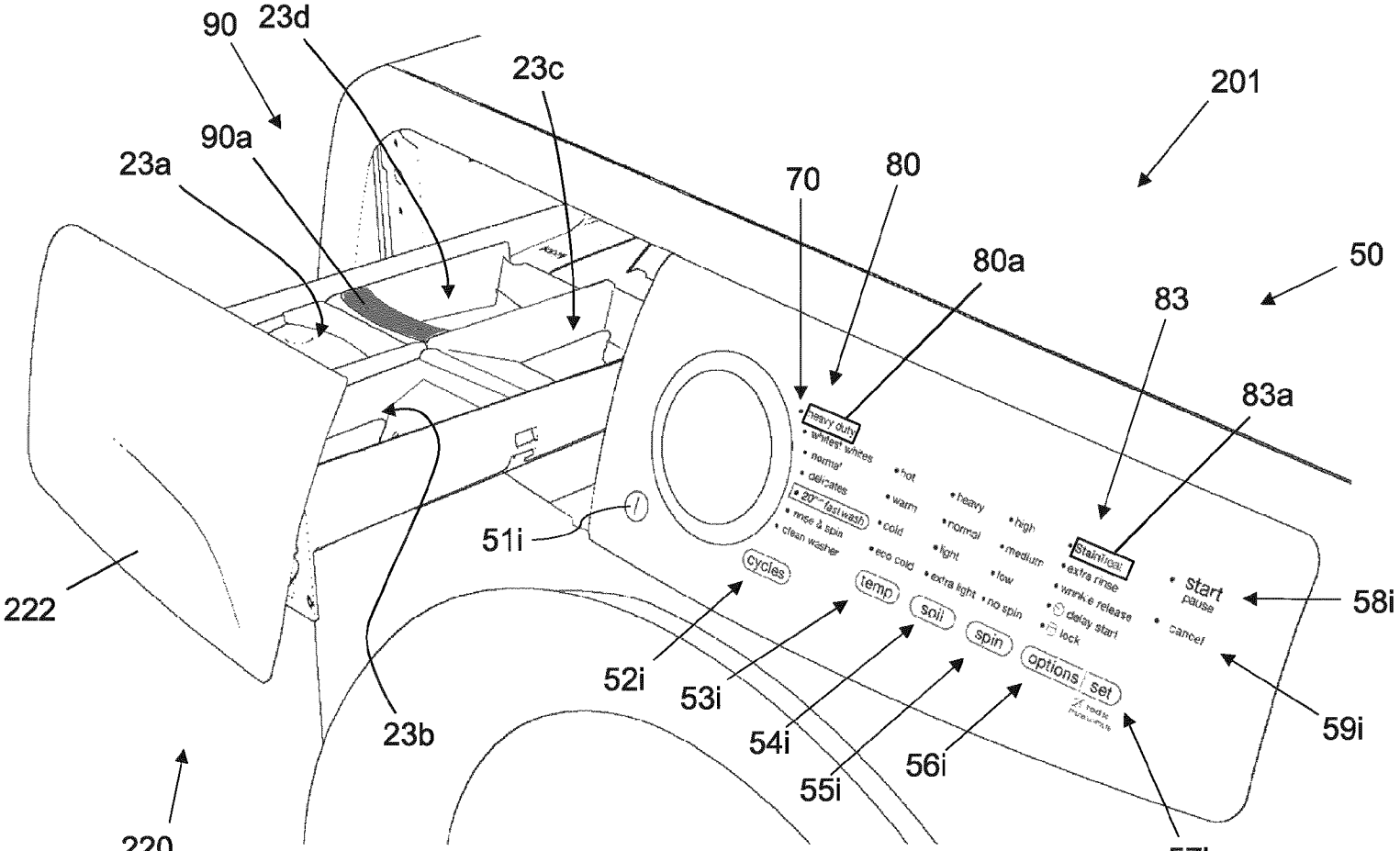
FIG. 5 shows a further preferred embodiment of FIG. 3.

With reference to FIG. 5 a laundry washing machine 201 according to a further preferred embodiment of the invention is described.

The laundry washing machine 201 differs from the laundry washing machine 1 previously described with reference to FIGS. 1 to 3 in that the second type output device of the control panel 250 constituted of the text "StainTreat" comprises a respective visual identifier 83, while the text "heavy duty" does not comprise any visual identifier.

In the laundry washing machine 201 according to this preferred embodiment none of the washing programs comprises a pre-wash phase while the option "StainTreat" provides for the fourth compartment 23*d* to be filled with a proper treating agent, for example a stain remover, for an efficient washing cycle.

The washing cycle includes the stain treatment phase that is performed utilizing the dose of stain remover of the fourth compartment 23*d*.

In the preferred embodiment here illustrated, the visual identifier 83 comprises a border frame 83*a* surrounding the text "StainTreat". The border frame 83*a* preferably comprises a determined colouring, more preferably has a specific colour, for example a green border frame.

According to the invention, the same colouring of the border frame 83*a* of the text "StainTreat" and of the fourth compartment 23*d* gives an indication to the user of a link between the two, i.e. that the "StainTreat" option implies the use of the fourth compartment 23*d*.

The user who selects the "StainTreat" option will be therefore advised to fill the fourth compartment 23*d* with a dose of treating agent, in the present case a dose of stain remover.

Advantageously, by providing the second type output device, preferably the text "StainTreat", with a visual identifier 83 and by providing the fourth compartment 23*d* with a second visual identifier 90 wherein both the identifiers 83, 90 comprise the same colouring, the usability of laundry washing machine 1 for the user is improved. The visual identifiers 83, 90, in fact, immediately show the link between the "StainTreat" option and the fourth compartment 23*d*.

Still advantageously, the washing program will be performed efficiently with the use of the stain remover in the stain treatment phase of the washing cycle.

Figure 6:
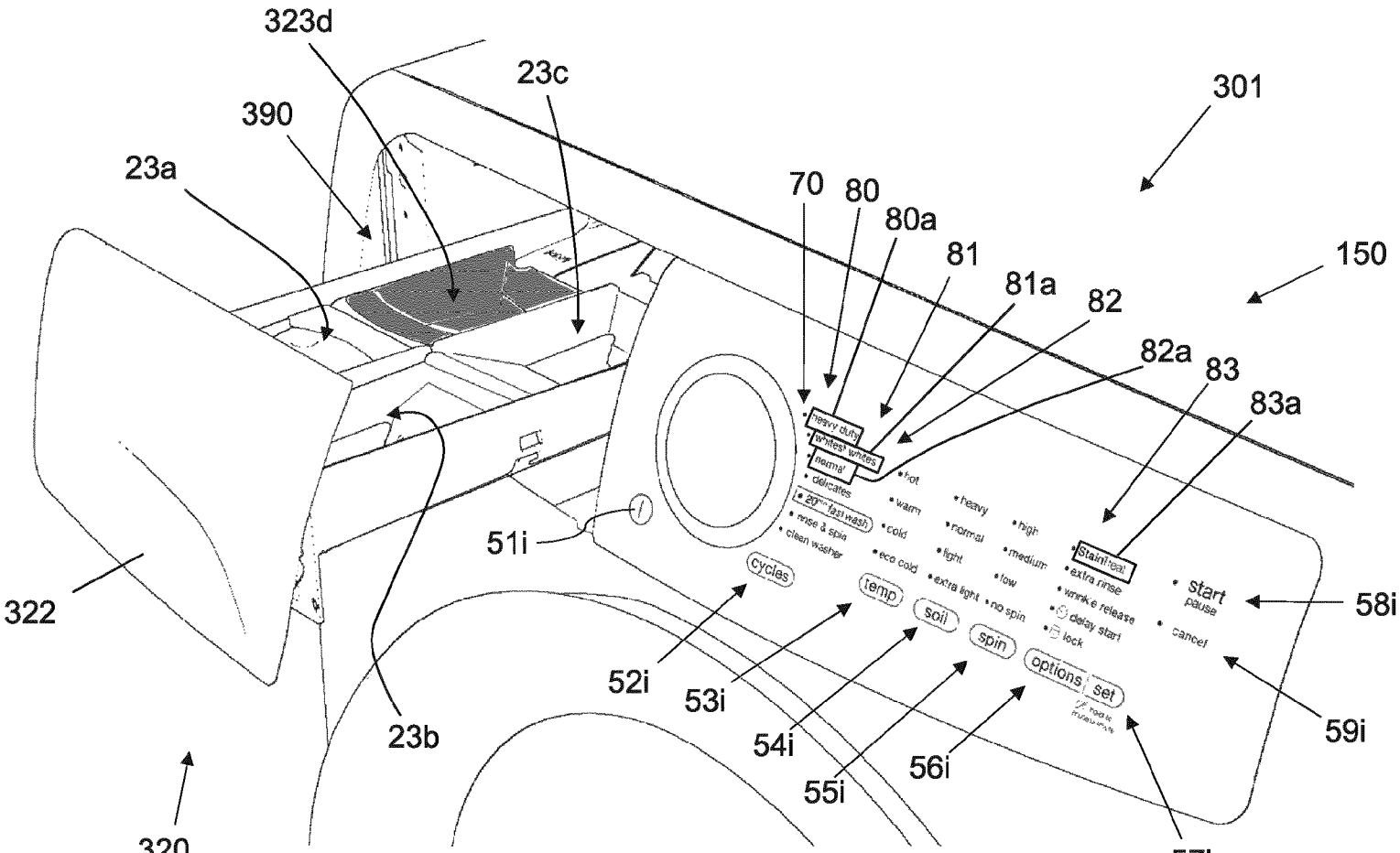
FIG. 6 shows a further preferred embodiment of FIG. 4.

With reference to FIG. 6 a laundry washing machine 301 according to a further preferred embodiment of the invention is described.

The drawer 322 of the treating agents dispenser 320 differs from the drawers previously described in that it comprises five compartments, 23*a*, 23*b*, 23*c*, 23*d* and 23*e*.

The first compartment 23*a* is preferably adapted for receiving a powder or a liquid detergent for the main wash. The second compartment 23*b* is preferably adapted for receiving a softener. The third compartment 23*c* is preferably adapted for receiving bleach. The fourth and the fifth compartments 23*d*, 23*e*, according to an aspect of the present invention, are preferably adapted for receiving other treating agents, as will better explained later.

The first compartment 23*a* is then preferably marked with the text "main wash", the second compartment 23*b* is preferably marked with the softener symbol and the text "liquid softener" and the third compartment 23*c* is preferably marked with the bleach symbol and the text "liquid bleach".

According to the invention, the fourth compartment 23*d* comprises a visual identifier 90 and the fifth compartment 23*d* also comprises a visual identifier 91.

In the preferred embodiment here illustrated, the visual identifier 90 of the fourth compartment 23*d* comprises a tab 90*a*, preferably a plastic tab. The plastic tab 90*a* may be a member connected to the fourth compartment 23*d* or, alternatively, integrally made with it. The tab 90*a* preferably has a green colour, as described above with reference to FIG. 4.

In the preferred embodiment here illustrated, the visual identifier 91 of the fifth compartment 23*e* comprises a tab 91*a*, preferably a plastic tab. The plastic tab 91*a* may be a member connected to the fifth compartment 23*e* or, alternatively, integrally made with it.

The interface unit 350 differs from the interface unit 150 previously described with reference to FIG. 4 in that the second type output device of the control panel 350 constituted of the text "StainTreat" comprises a visual identifier 383.

In the preferred embodiment here illustrated, the visual identifier 383 comprises a border frame 383*a* surrounding the text "StainTreat". The border frame 383*a* preferably comprises a determined colouring, more preferably has a specific colour, for example a red border frame, which is the same colouring of the visual identifier 91 (tab 91*a*) of the fifth compartment 23*e*.

The visual identifier 383 is also different from the other visual identifiers 80, 81, 82 surrounding the respective text "heavy duty", "whitest whites" and "normal". The other visual identifiers 80, 81, 82, as explained above, have the same colouring of the visual identifier 90 (tab 90*a*) of the fourth compartment 23*d*.

According to the invention, the same colouring of the border frames 80*a*, 81*a*, 82*a* of the texts "heavy duty", "whitest whites", "normal" and of the fourth compartment 23*d* gives an indication to the user of a link between one of the washing program and the fourth compartment 23*d*, i.e. that one of the three washing programs implies the use of the fourth compartment 23*d*.

The user who selects one of these three washing programs will be therefore advised to fill the fourth compartment 23*d* with an additional dose of treating agent, in the present case a dose of detergent for the pre-wash phase.

Furthermore, the same colouring of the border frame 383*a* of the text "StainTreat" and of the fifth compartment 23*e* gives an indication to the user of a link between the two, i.e. that the "StainTreat" option implies the use of the fifth compartment 23*e*.

The user who selects the "StainTreat" option will be therefore advised to fill the fifth compartment 23*e* with a dose of treating agent, in the present case a dose of stain remover.

Advantageously, by providing the first type output devices, preferably the texts "heavy duty", "whitest whites" and "normal" with visual identifiers 80, 81 and 82 and by providing the fourth compartment 23*d* with a visual identifier 90 wherein the identifiers 80, 81, 82 and 90 comprise the same colouring and by providing the second type output device, preferably the text "StainTreat" with a visual identifier 83 and by providing the fifth compartment with a visual identifier 91 wherein both the identifiers 83, 91 comprise the same colouring, the usability of laundry washing machine for the user is improved. The visual identifiers 80, 81, 82, 90, in fact, immediately show the link between one of the "heavy duty", the "whitest whites" and the "normal" washing program and the fourth compartment 23*d* and the visual identifiers 83, 91, in fact, immediately show the link between one of the "StainTreat" option and the fifth compartment 23*e*.

Still advantageously, the selected washing program and/or the washing program option will be performed efficiently with the use of correct treating agent during the washing cycle.

Figure 7:
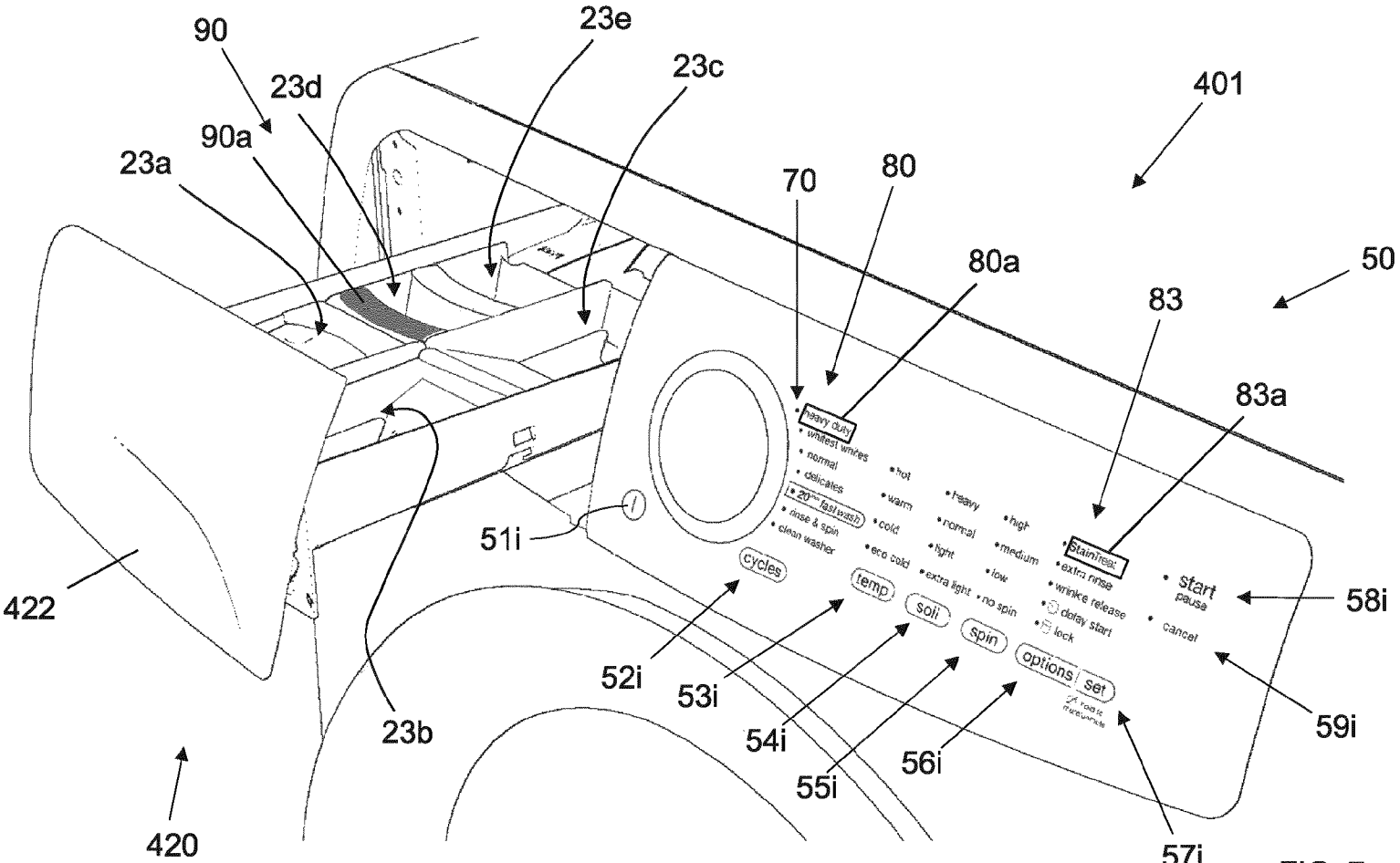
FIG. 7 shows a further preferred embodiment of FIG. 4.

With reference to FIG. 7 a laundry washing machine 401 according to a further preferred embodiment of the invention is described.

Firstly, the drawer 422 of the treating agents dispenser 420 differs from the drawer 20 previously described with reference to FIG. 4 in that the second visual identifier 490 is realized by completely colouring the fourth compartment 423*d*, preferably with a green colour, instead of comprising the green tab 90*a*.

The first compartment 23*a* is preferably adapted for receiving a powder or a liquid detergent for the main wash. The second compartment 23*b* is preferably adapted for receiving a softener. The third compartment 23*c* is preferably adapted for receiving bleach. The fourth compartment 423*d* according to an aspect of the present invention, is preferably adapted for receiving other treating agents, as will better explained later.

The first compartment 23*a* is then preferably marked with the text "main wash", the second compartment 23*b* is preferably marked with the softener symbol and the text "liquid softener" and the third compartment 23*c* is preferably marked with the bleach symbol and the text "liquid bleach".

The interface unit 450, then, differs from the interface unit 150 previously described with reference to FIG. 4 in that the second type output device of the control panel 350 constituted of the text "StainTreat" comprises a visual identifier 483.

In the preferred embodiment here illustrated, the visual identifier 483 comprises a border frame 483*a* surrounding the text "StainTreat". The border frame 483*a* preferably comprises a determined colouring, more preferably has the same colour of the other visual identifiers 80, 81 and 82, for example a green border frame.

Therefore, the output devices, preferably the texts "heavy duty", "whitest whites", "normal" and "StainTreat", and the fourth compartment 423*d* are provided with visual identifiers 80, 81, 82, 483 and 90 which comprise the same colouring.

The laundry washing machine 401 according to this preferred embodiment may have various functioning modes.

In a first preferred functioning mode, the user may preferably select one of the three washing programs provided with the green visual identifier, i.e. "heavy duty" or "whitest whites" or "normal", while the option "StainTreat" is not selected.

In this case, the fourth compartment 423*d* is preferably filled with an additional dose of detergent which allows to perform a pre-wash phase during the selected washing program.

According to the invention, the same colouring of border frames 80*a*, 81*a*, 82*a* of the texts "heavy duty", "whitest whites", "normal" and of the fourth compartment 423*d* gives an indication to the user of a link between one of the washing program and the fourth compartment 423*d*, i.e. that each of the three washing programs implies the use of the fourth compartment 423*d*.

The user who selects one of these three washing programs will be therefore advised to fill the fourth compartment 423*d* with an additional dose of treating agent, in the present case a dose of detergent for the pre-wash phase.

Advantageously, the usability of laundry washing machine 401 for the user is improved.

Still advantageously, the selected washing program will be performed efficiently with the use of detergent in the pre-wash phase.

In a second preferred functioning mode, the user may preferably select both one of the three washing programs provided with the green visual identifier, i.e. "heavy duty" or "whitest whites" or "normal", and the "StainTreat" option.

For example, both the "heavy duty" program and the "StainTreat" option may be selected.

In this case, the fourth compartment 423*d* is preferably filled with a dose of stain remover which allows to perform a stain treatment phase during the washing program selected.

Therefore, according to this preferred embodiment, the fourth compartment 423*d* is not filled with an additional dose of detergent, thus excluding the use of any dose of detergent in a pre-wash phase.

The user who selects one of these three washing programs and also a "StainTreat" option will be therefore advised to fill the fourth compartment 423*d* with a treating agent, preferably a stain remover. In the present case, preferably, the use of stain remover in the stain treatment phase has priority over an additional dose of detergent for the pre-wash phase.

According to the invention, the same colouring of the border frames 80*a*, 81*a*, 82*a*, 383*a* of the texts "heavy duty", "whitest whites", "normal", "StainTreat" and of the fourth compartment 423*d* gives an indication to the user of a link between the "StainTreat" option and the fourth compartment 423*d*, i.e. that "StainTreat" option implies the use of the fourth compartment 423*d*.

The user who selects one of these three washing programs and also the "StainTreat" option will be therefore advised to fill the fourth compartment 423*d* with an additional dose of treating agent, in the present case a dose of stain remover for the stain treatment phase (rather than a dose of detergent for a pre-wash phase).

Advantageously, the usability of laundry washing machine 401 for the user is improved.

Still advantageously, the selected washing program will be performed efficiently with the use of stain remover in the stain treatment phase.

It has thus been shown that the present invention allows all the set objects to be achieved. In particular, it makes it possible to provide a laundry washing machine with features that improves the usability of laundry washing machine for users compared to known laundry washing machines.

It is underlined that the laundry washing machine illustrated in the enclosed Figures is of the front-loading type; however it is clear that the system according to the invention can be applied as well to a top-loading washing machine, substantially without any modification.

While the present invention has been described with reference to the particular embodiments shown in the Figures, it should be noted that the present invention is not limited to the specific embodiments illustrated and described herein; on the contrary, further variants of the embodiments described herein fall within the scope of the present invention, which is defined in the claims.

The invention claimed is:

1. A laundry washing machine connectable to a water mains, the laundry washing machine comprising:

a cabinet supporting a washing drum adapted to receive laundry and a washing tub external to the washing drum;

a treating agents dispenser connectable to the water mains and comprising compartments adapted to be filled with at least one treating agent;

a supply line, fluidly connecting the treating agents dispenser and the washing tub;

a control panel comprising input devices configured to receive a selection of washing programs and/or parameters of the machine and comprising visual identifiers on an outer surface of the cabinet and configured to indicate information to a user regarding features of the machine and/or the settings/status of the machine; and a control unit configured to control functioning of the laundry washing machine;

wherein: at least one visual identifier of the visual identifiers of the control panel identifies the selected washing program and the at least one visual identifier and at least one compartment of the compartments of the treating agents dispenser comprise a common visual identifier to correlate each visual identifier of the visual identifiers of the control panel to a corresponding compartment of the compartments of the treating agents dispenser for the user to insert a dose of a treating agent into the compartment, the at least one visual identifier of the visual identifiers comprises a first visual identifier, wherein the first visual identifier differs from other visual identifiers of the control panel, and the at least one compartment of the compartments of the treating agents dispenser comprises a second visual identifier, the first visual identifier being independent from the second visual identifier, and the first visual identifier and the second visual identifier have a same colouring.

2. The laundry washing machine according to claim 1, wherein the second visual identifier differs from visual identifiers of other compartments.

3. The laundry washing machine according to claim 1, wherein the colouring comprises a colour.

4. The laundry washing machine according to claim 1, wherein the colouring comprises a combination of colours.

5. The laundry washing machine according to claim 1, wherein the first visual identifier further identifies a specific washing program option which provides for that a specific treating agent is inserted into the at least one compartment.

6. The laundry washing machine according to claim 5, wherein the specific washing program option provides for that a pre-wash phase is performed and that the specific treating agent which is inserted into the at least one compartment is a detergent.

7. The laundry washing machine according to claim 5, wherein the specific washing program option provides for that a stain treatment phase is performed and that the treating agent which is inserted into the at least one compartment is a stain remover.

8. The laundry washing machine according to claim 5, wherein the selected washing program provides for that a pre-wash phase is performed and the specific washing program option provides for that a stain treatment phase is performed and the specific treating agent which is inserted into the at least one compartment is a stain remover.

9. The laundry washing machine according to claim 1, wherein the first visual identifier is both associated to a specific washing program and to a specific washing program option which provides for that a specific treating agent is inserted into the at least one compartment.

10. The laundry washing machine according to claim 1, wherein the at least one of the visual identifiers comprises one or more of the elements of the group comprising: alphanumeric, texts, lines, images, icons, alphanumeric displays or a combination thereof.

11. The laundry washing machine according to claim 10, wherein the at least one visual identifier of the visual identifiers of the control panel further include one or more lights associated with the common visual identifier.

* * * * *